United States Patent [19]

Gonzalez

[11] Patent Number: 4,679,793

[45] Date of Patent: Jul. 14, 1987

[54] TABLE GAME

[76] Inventor: Ramon Gonzalez, 2721 W. Wellington, Chicago, Ill. 60618

[21] Appl. No.: 838,308

[22] Filed: Mar. 10, 1986

[51] Int. Cl.[4] ..... A63F 7/24

[52] U.S. Cl. ..... 273/85 R; 273/40; 273/413

[58] Field of Search ..... 273/85 R, 40, 413

[56] References Cited

U.S. PATENT DOCUMENTS

| | | | |
|---|---|---|---|
| 712,923 | 11/1902 | Frysinger | 273/40 |
| 735,132 | 8/1903 | McCutchen, Jr. | 273/40 X |
| 797,317 | 8/1905 | Peter | 273/40 |
| 3,702,699 | 11/1972 | Smith | 273/413 X |
| 3,726,524 | 4/1973 | Prischak et al. | 273/40 |
| 3,738,647 | 6/1973 | Morrill | 273/40 |

FOREIGN PATENT DOCUMENTS

| | | | |
|---|---|---|---|
| 2409068 | 7/1979 | France | 273/40 |
| 441290 | 1/1936 | United Kingdom | 273/40 |

*Primary Examiner*—Paul E. Shapiro
*Attorney, Agent, or Firm*—Edward J. Chalfie

[57] ABSTRACT

A table game as provided to be played by up to four players and to simulate the action of a boxing contest, or the like. The game includes a flat board with players and markers and an adjustable pendulum used by the players to attempt to knock over the opponents' game pieces.

4 Claims, 1 Drawing Figure

TABLE GAME

BACKGROUND OF THE INVENTION

1. Field Of The Invention

The present invention relates to a table game played by up to four persons and which simulates the actual sport of boxing or a similar sport involving physical contact.

2. Description Of The Prior Art

The prior art in this field includes board games and other games designed for competition and amusement. Included in this broad category are Parcheesi-type games involving a track or tracks for movement of game pieces to an ultimate objective. Also included in this group are quasi-military-type games involving opposing forces. Such games include chess and checkers.

Also included in the prior art are video games and other electronic games, which are often complicated and expensive, requiring a sizable investment.

The game embodying the present invention combines the low cost and portability of a simple board game with the action of a video game, while simulating the sport of boxing or a similar sport.

SUMMARY OF THE INVENTION

The present invention provides an action board game for simulating the sport of boxing or a similar contact sport, including the martial arts such as karate. The game includes a generally circular flat board which is adapted to be placed on a table for play. Also provided is an upright standard with an attached beam for supporting a pendulum over the field of play. The standard is provided with a clamp for attaching the standard to the table. The beam is provided with adjustment notches for centering the pendulum over the board.

The game may be played by two to four players. Each player is provided with a boxer figure in a fighting stance. This figure is placed near the player in a spot on the board within striking distance of the boxing-glove pendulum. Also provided on the board for each player is a home base and a plurality of scoring spaces to be occupied by markers from the player's home base.

DESCRIPTION OF THE DRAWING FIGURE

Drawing FIG. 1 is a general perspective view of the table game embodying the present invention.

DETAILED DESCRIPTION OF THE PREFERRED EMBODIMENT

Figure 1:
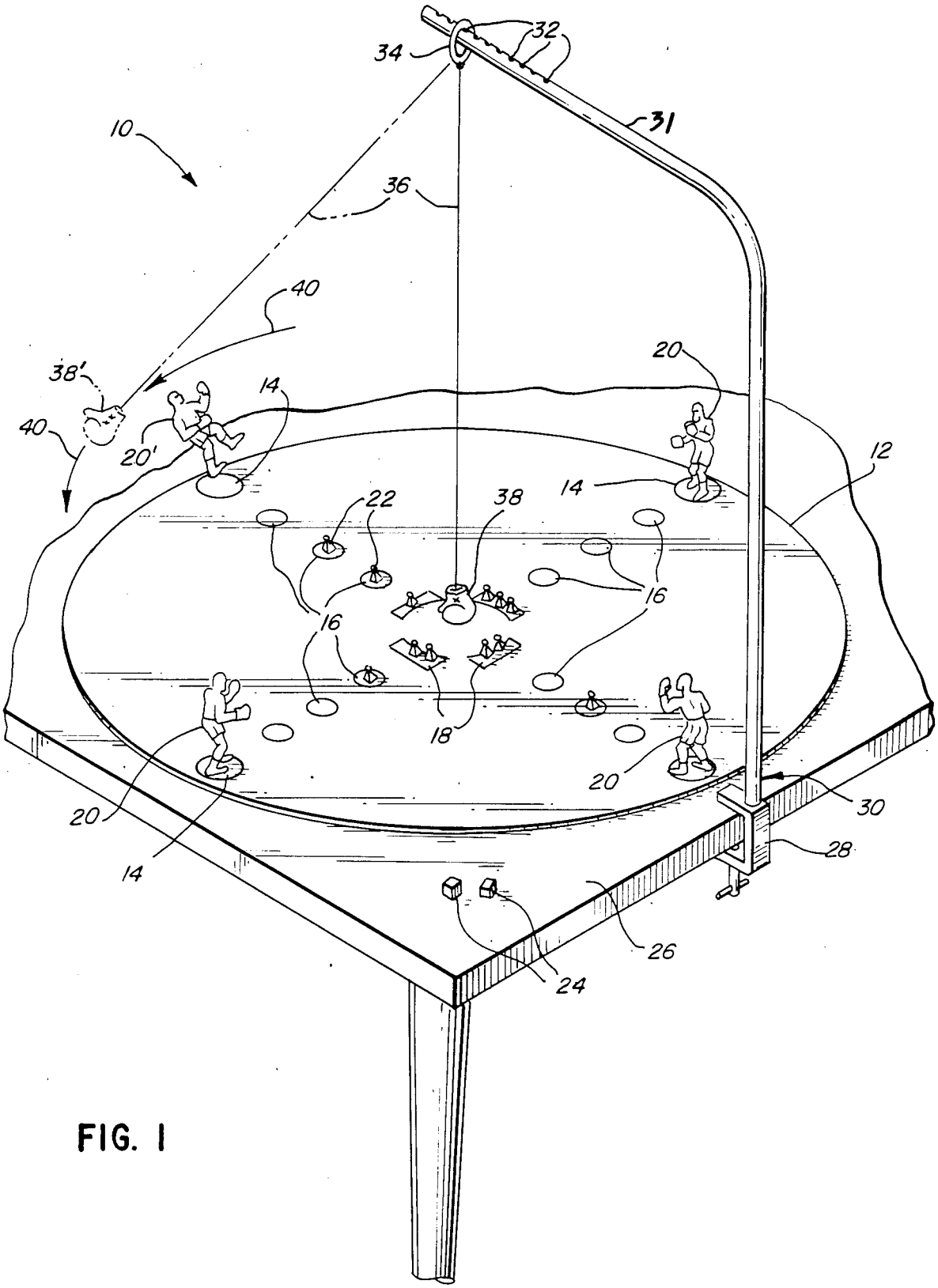

Turning now to the drawing figure, the table game embodying the present invention is generally indicated by reference character 10. A partial section of a table 26 is shown to indicate the proper arrangement of the game for playing. Playing board 12 is generally circular in shape although it may be square or any other suitable shape to present an attractive appearance. It is important that the table size not greatly exceed the dimensions of board 12 so that the board can be somewhat centered if the game is to be played more than two players.

Standard 30 is provided with clamp 28 and is bent to form horizontal beam 31 which overlies the playing surface of board 12. Beam 31 is provided with a plurality of notches 32. Suspended from one of notches 32 is pendulum 38 which is dependent from beam 31 by ring 34 and cord 36. Notches 32 provide for adjustment of ring 34 along beam 31 so that pendulum 38 may be centered on the playing surface of board 12.

Each player is provided with a boxing FIG. 20 in a fighting stance which may be placed upright in one of fighting positions 14 assigned to that player and located near the outer periphery of board 12. Each player is also provided with three markers 22 which, in the initial stage of the game, are placed at one of the home bases 18, corresponding to that player's position 20 and located radially inwardly therefrom in proximity to the center of board 12.

Located between each of the fighting positions 14 and its associated home base 18 are three scoring circles 16. The scoring circles 16 are aligned collinearly with their associated fighting position 14 and home base 18.

The game embodying the present invention is begun by the roll of dice 24 by each player to determine by point total the starting player. The dice are only used at the beginning of each new game in such manner. The order of play is then determined by advancing in a clockwise or counterclockwise fashion, according to the preference of the players.

The first player to play grasps the pendulum 38 and swings it through at least one complete revolution around the board in an attempt to knock over one of his opponents' boxing Figures 20. Since the pendulum must be swung through at least one complete revolution, there is an element of luck as well as an element. of skill involved since, theoretically, any one of the boxing Figures 20 may be toppled by pendulum 38, including the boxing figure representing the player swinging the pendulum.

As the pendulum, shown in phantom as 38', moves along path 40, it may encounter and topple a boxing figure, represented in this instance by reference character 20'. Once a boxing figure is knocked down in this manner, the player whom that boxing figure represents must take a marker from his home base 18 and place it in one of the scoring circles in his playing area. In this manner, the players know that that player's figure has been knocked down once. The boxing figure 20' is then replaced in its fighting stance in position 14 and the game resumes with the next player taking his turn at swinging the pendulum.

The first player to be knocked down three times is out of the game, with the game continuing with the remaining players until there is one player left who is declared the winner.

While the invention has been described in connection with a preferred embodiment, it will be understood that it is not intended to limit the invention thereto, but is intended to cover all modifications and alternative constructions falling within the spirit and scope of the invention as expressed in the appended claims.

What is claimed is:

1. a table game for simulating the sport of boxing, or the like, including a horizontal playing surface adapted to be placed on a table, an overhead support means attachable to said table and having a horizontal beam member in substantial overlaying relationship to said playing surface, a pendulum dependent from said horizontal beam, means for centering said pendulum above said playing surface wherein said centering means comprises a plurality of notches defined in said beam with said pendulum suspended from a ring encircling said beam and placable in any of said notches, a plurality of playing fugures positionable on said playing surface to be vulnerable to said pendulum when said pendulum is swung in a circular motion above said playing surface.

2. A table game for simulating the sport of boxing, or the like, as in claim 1 wherein said pendulum is formed in a likeness of a boxing glove.

3. A table game for simulating the sport of boxing, or the like, as in claim 1 including a plurality of counting markers to determine the status of play.

4. A table game for simulating the sport of boxing, or the like, as in claim 3 including marked locations on said horizontal playing surface radiating outward from the center of said playing surface, for the placement of said markers.

* * * * *